US009325048B2

(12) United States Patent
Seo et al.

(10) Patent No.: US 9,325,048 B2
(45) Date of Patent: Apr. 26, 2016

(54) MULTIPLEXER WITH COMMON PORT FEEDING STRUCTURE

(71) Applicant: Innertron, Inc., Incheon (KR)

(72) Inventors: Soo-Duk Seo, Incheon (KR); Kwang-Myoung Heo, Bucheon-si (KR)

(73) Assignee: Innertron, Inc., Incheon (KR)

( * ) Notice: Subject to any disclaimer, the term of this patent is extended or adjusted under 35 U.S.C. 154(b) by 9 days.

(21) Appl. No.: 14/218,004

(22) Filed: Mar. 18, 2014

(65) Prior Publication Data

US 2015/0130562 A1 May 14, 2015

(30) Foreign Application Priority Data

Nov. 11, 2013 (KR) ..... 10-2013-0136438

(51) Int. Cl.
*H01P 1/213* (2006.01)
*H01P 5/12* (2006.01)

(52) U.S. Cl.
CPC ..... *H01P 1/2136* (2013.01); *H01P 5/12* (2013.01)

(58) Field of Classification Search
CPC .... H01P 1/213; H01P 1/2133; H01P 21/2136
USPC ..... 333/132, 134–135
See application file for complete search history.

(56) References Cited

U.S. PATENT DOCUMENTS 4,091,344 A * 5/1978 LaTourrette ..... 333/134
2006/0145782 A1* 7/2006 Liu et al. ..... 333/132

FOREIGN PATENT DOCUMENTS

JP 2000-183607 6/2000
JP 2005-277594 B 10/2005
KR 10-2008-0056545 A 6/2008
KR 10-2008-0114104 B 12/2008
KR 10-0899102 5/2009

OTHER PUBLICATIONS

Korean Office Action dated Sep. 29, 2014 issued in corresponding Korean Application No. 10-2013-0136438.

Korean Notice of Allowance dated Feb. 6, 2015, received in corresponding Korean Application No. 10-2013-0136438.

* cited by examiner

*Primary Examiner* — Benny Lee
*Assistant Examiner* — Albens Dieujuste
(74) *Attorney, Agent, or Firm* — Knobbe, Martens, Olson & Bear, LLP

(57) ABSTRACT

A multiplexer with a common port feeding structure is disclosed. The multiplexer with a common port feeding structure of the present invention comprises: a housing comprising an antenna connector connected to an antenna for bidirectional transmitting and receiving and a plurality of input/output connectors bidirectionally inputting and outputting a specific frequency band of wireless signals which are input/output through the antenna; a plurality of band-pass filter units mounted inside the housing to transmit wireless signals at between the antenna connector and the input/output connector to pass a specific frequency band; and a coupling unit having a plurality of feeding members to couple the antenna connector and each of the plurality of band-pass filter units.

10 Claims, 6 Drawing Sheets

MULTIPLEXER WITH COMMON PORT FEEDING STRUCTURE

CROSS-REFERENCE TO RELATED APPLICATIONS

This application claims the benefit of Korean Patent Application No. 10-2013-0136438, filed on Nov. 11, 2013, entitled "Multiplexer with common port feeding structure", which is hereby incorporated by reference in its entirety into this application.

BACKGROUND

1. Field

The present invention relates to a multiplexer with a common port feeding structure.

2. Description of the Related Technology

In response to the development of recent wireless communication technologies, various wireless communication services, which can be used in wireless terminals such as mobile phones, personal digital assistants (PDAs), personal computers, laptops, for example, Global System for Mobile communication (GSM), Personal Communication Services (PCS), World Interoperability for Microwave Access (WiMAX), Wireless LAN (WLAN), Wireless Broadband Internet (WiBro), Bluetooth and the like, have been developed.

Here, GSM uses a 890-960 MHz band, PCS uses a 1.8 GHz band, WiMAX uses a 3.6-3.8 GHz band, IEEE 802.11b for WLAN uses a 2.4 GHz band which is an Industrial, Scientific & Medical (ISM) band and IEEE 802.11a uses a 5 GHz band which is unlicensed national information infrastructure (UNII). WiBro uses a 2.3 GHz frequency band and Bluetooth uses a 2.4 GHz band.

A multi-band antenna system has been used to receive wireless communication services provided through various frequency bands by using one wireless terminal.

Background technology of the present invention has been disclosed in KR Patent Publication No. is 2008-0056545 (published Jun. 23, 2008, "Concurrent mode antenna system").

SUMMARY

Embodiments of the present invention are to provide a multiplexer with a common port feeding structure which is able to use a plurality of wireless communication services by using one antenna and use each wireless communication service simultaneously.

According to an aspect of the present invention, there is provided a multiplexer with a common port feeding structure comprising: a housing comprising an antenna connector connected to an antenna for bidirectional transmitting and receiving and a plurality of input/output connectors bidirectionally inputting and outputting a specific frequency band of wireless signals which are input/output through the antenna; a plurality of band-pass filter units mounted inside the housing to transmit wireless signals at between the antenna connector and the input/output connector to pass a specific frequency band; and a coupling unit having a plurality of feeding members to couple the antenna connector and each of the plurality of band-pass filter units. The coupling unit may comprise a rod-shaped conductive bar of which one end is connected to the antenna connector and the other end is extended in an inner direction of the housing, and the plurality of feeding members may be arranged to be spaced-apart along the longitudinal direction of the conductive bar.

The coupling unit may comprise a coupling cavity which is formed by a groove formed in a direction from the upper part to the bottom part of the housing at between the antenna connector of the housing and the plurality of band-pass filter units.

The number of the coupling cavity may correspond to the number of the plurality of feeding members. The coupling unit may be provided between the plurality of coupling cavities and further comprise a plurality of coupling partition walls having coupling windows which are opened parts of the coupling partition walls.

The conductive bar may be arranged to pass through the plurality of coupling cavities and the plurality of coupling partition walls.

The feeding member may be arranged to be spaced-apart and opposed to a resonator adjacent to the band-pass filter unit.

The feeding member may be extended outwardly from the central axis of the conductive bar to have a greater diameter than that of the conductive bar.

The feeding member may comprise a rod-shaped coupling bar which is extended outwardly from the central axis of the conductive bar; and a coupling disk which is coupled to the end part of the coupling bar.

The coupling disk may be a circular or polygonal shape.

The plurality of band-pass filter units and the plurality of input/output connectors may be arranged on both sides on the basis of the coupling unit.

The plurality of band-pass filter units and the plurality of input/output connectors may be arranged radially around the central axis of the coupling unit.

The band-pass filter unit may comprise a plurality of cavities which are formed by grooves formed in a direction from the upper part to the bottom part of the housing at between the antenna connector of the housing and the plurality of band-pass filter units; a resonator installed in each of the plurality of cavities; and a partition wall formed with a window which is an open part of the partition wall to couple between the plurality of cavities.

According to an embodiment of the present invention, implementation of a common antenna port feeding structure allows providing a plurality of wireless communication services by using one antenna and using each wireless communication service at the same time.

In addition, an open-type coupling structure which is easy to be installed and has a simple-linear structure is implemented so that productivity of products can be increased due to the simple-linear coupling structure which simplifies a manufacturing process.

DESCRIPTION OF EXEMPLARY EMBODIMENTS

While the present invention has been described with reference to particular embodiments, it is to be appreciated that various changes and modifications may be made by those skilled in the art without departing from the spirit and scope of the present invention, as defined by the appended claims and their equivalents. Throughout the description of the present invention, when describing a certain technology is determined to evade the point of the present invention, the pertinent detailed description will be omitted.

Hereinafter, the invention will be described below in more detail with reference to the accompanying drawings, in which those components are rendered the same reference number that are the same or are in correspondence, regardless of the figure number, and redundant explanations are omitted.

Figure 1:
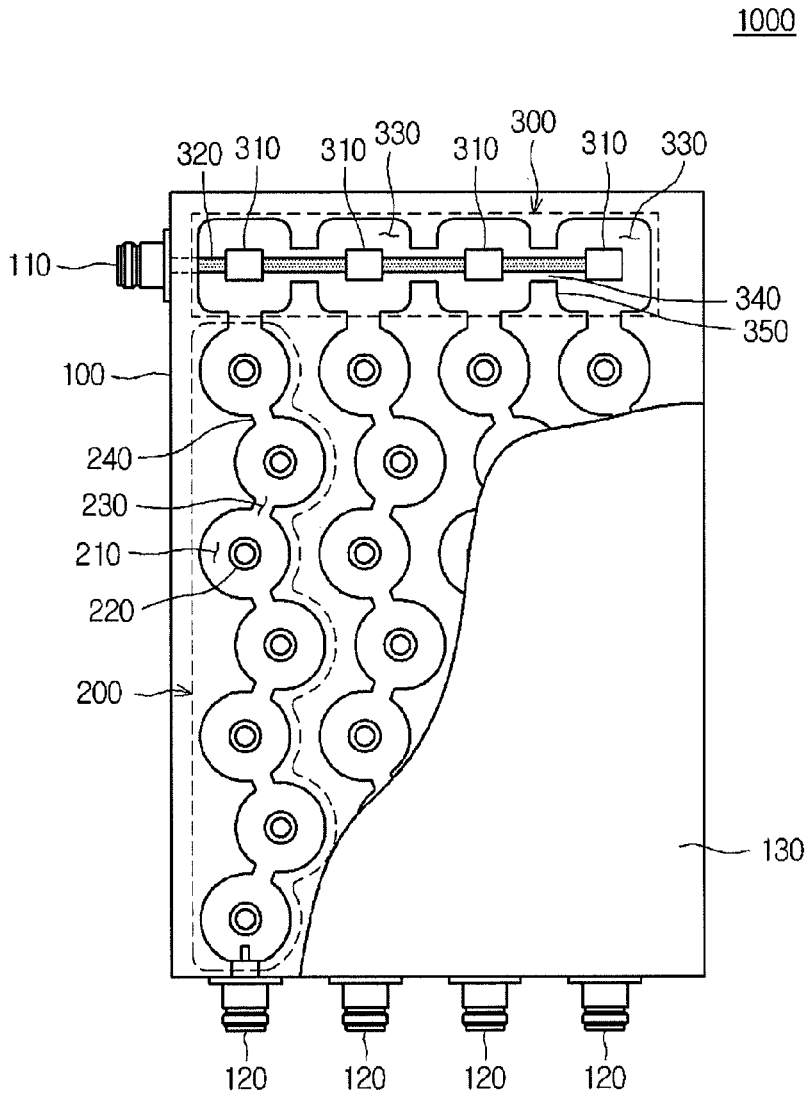
FIG. 1 illustrates a multiplexer with a common port feeding structure according to the first embodiment of the present invention viewed from the top.
Figure 2:
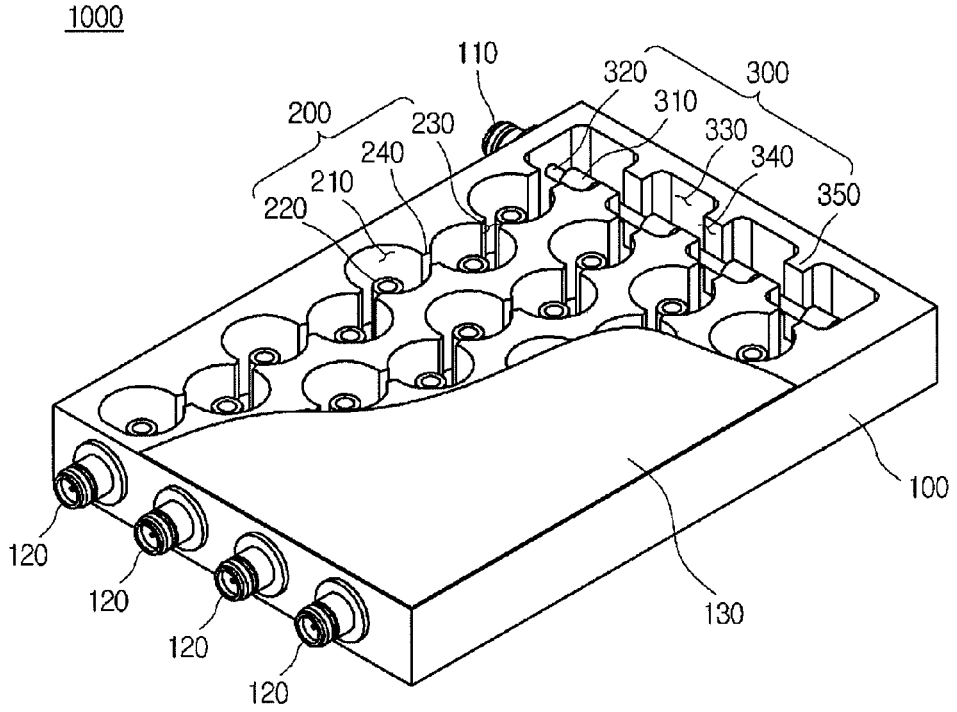
FIG. 2 is a perceptive view illustrating the multiplexer with a common port feeding structure according to the first embodiment of the present invention of FIG. 1.

FIG. 1 illustrates a multiplexer with a common port feeding structure according to the first embodiment of the present invention viewed from the top and FIG. 2 is a perceptive view illustrating the multiplexer with a common port feeding structure according to the first embodiment of the present invention of FIG. 1.

As shown in FIG. 1 and FIG. 2, the multiplexer with a common port feeding structure according to the first embodiment of the present invention 1000 comprises a housing 100 comprising an antenna connector 110 and a plurality of input/output connectors 120 and a coupling unit 300 comprising a plurality of band-pass filter units 200 and a plurality of feeding members 310 mounted in the housing 100.

According to an embodiment of the present invention, implementation of a common antenna port feeding structure allows using a plurality of wireless communication services by using one antenna and using each wireless communication service at the same time.

In addition, according to an embodiment of the present invention, implementation of the coupling unit 300 having an open-type coupling structure which is thus easy to be installed and has a simple-linear structure so that productivity of products can be increased due to the simple-linear coupling structure which further simplifies a manufacturing process.

For example, in a short-type coupling structure that is a structure connecting one antenna connector radially with each of band-pass filter units around the antenna connector, there is significant difficulty to control the distance between filers (which is to adjust phase) not to affect to the frequency band of an adjacent filter in actual manufacturing process since space is limited.

Furthermore, since the resonator, which is adjacent to the antenna connector in each filter unit, is connected in a short type with one antenna connector by soldering as a metal connecting means between the filter and the resonator, it is very difficult to adjust phase of each frequency band from wireless signals having various frequency bands and structure is very complicate so that it is difficult to reduce its manufacture time and cost.

However, as shown in FIG. 1 and FIG. 2, an open-type coupling structure of the present invention which can be easily installed and have a simple-linear structure does not increase size of a multiplexer and facilitates controlling the distance between filters which further minimizes an interference phenomenon between filters. In addition, a manufacturing process can be simplified and thus the productivity can be significantly increased due to such an open-type coupling structure which can be easily installed and have a simple-linear structure.

The configuration of the multiplexer with a common port feeding structure 1000 according to an embodiment of the present invention will be explained in more detail with reference to FIG. 1 and FIG. 2.

The housing 100 comprises an antenna connector 110 connected to an antenna (not shown) for bidirectional transmitting and receiving and a plurality of input/output connectors 120 bidirectionally inputting and outputting a specific frequency band of wireless signals which are input/output through the antenna.

The housing 100 is a box-type in FIG. 1 and FIG. 2 but it is not limited thereto. It can be changed to any type as needed.

Inside of the housing 100 can be isolated from outside by a cover 130 as shown in FIG. 1 illustrating a multiplexer with a common port feeding structure viewed from the top.

The antenna connector 110 may be formed on one side of the housing 100 and the plurality of input/output connectors 120 may be formed on another side of the housing 100.

The plurality of input/output connectors 120 may be connected with a signal processing circuit (not shown), which processes a wireless signal input/output through an antenna. The signal processing circuit may process signals transmitted through each input/output connector 120 according to a frequency band. The signal processing circuit may include, for example, a RF circuit.

The band-pass filter unit 200 allows passing a specific frequency band among various frequency bands. As shown in FIG. 1, the band-pass filter unit 200, which is mounted inside the housing 100, passes selectively a predetermined specific frequency band by transmitting a wireless signal at between the antenna connector 110 and the input/output connector.

A plurality of band-pass filter units 200 may be provided inside the housing 100 to be connected to the coupling unit 300 which will be explained below as indicated by the dotted line in FIG. 1.

Such plurality of band-pass filter units 200 allow using selectively a plurality of wireless communication services provided through various frequency bands and using each wireless communication service at the same time by being mounted inside the housing 100.

The band-pass filter unit 200 transmits signals between the antenna connector 110 and the individual input/output connector 120 to pass the signal of a particular frequency band. For this purpose, the band-pass filter unit 200 may comprise a plurality of cavities 210 formed inside the housing 100 and a resonator 220 may be mounted in each cavity 210.

The resonator 220 selects a particular frequency band among wireless signals input through the antenna and a shape can be made in various shapes according to design conditions such as a cylindrical shape having a hollow at the central axis.

As shown in FIG. 2, each of cavities 210 may be a long groove formed in a direction from the upper part to the bottom part of the housing 100. Thus, a partition wall 240 may be formed between the cavities 210 forming groove in the housing 100.

Each cavity 210 may be a cylindrical shape as shown in FIG. 2 but it is not limited thereto. The cavity 210 can be provided in various shapes such as a box shape as shown in another embodiment which will be described below.

The band-pass filter unit 200 may connect the resonator 220 installed in the cavity 210 which is adjacent to the input/output connector 120 with a wire of the input/output connector 120 in a short type or open type. According to an embodiment of the present invention, 50 ohm wire of the input/output connector 120 may be connected with the resonator 220 of the adjacent cavity 210 in an open type.

As shown in FIG. 1 and FIG. 2, the partition wall 240 may have a window 230 which is an opened part of the partition wall to form a signal transmission path between the cavities 210 adjacent to each other which is to couple between the cavities 210 adjacent to each other.

According to an embodiment of the present invention, the cavity 210 may transmit a signal along the direction such as in a zigzag where the windows 230 are formed but it is not limited thereto. The plurality of cavities 210 can be also arranged in various types such as in a row or in a plurality of rows and columns.

The coupling unit 300, as shown in FIG. 1 and FIG. 2, is mounted in the housing 100 and plays a role of coupling between the antenna connector 110 and the plurality of band-pass filter units 200.

The coupling unit 300 according to an embodiment of the present invention may be a coupling structure comprising a plurality of feeding members 310 to couple (which is to form a signal transmission path) the antenna connector 110 and each of the plurality of band-pass filter units 200 in an open type.

The coupling unit 300 may comprise a rod-shaped conductive bar 320 and a plurality of feeding members 310 which are arranged to be spaced-apart along the longitudinal direction of the conductive bar 320.

Referring to FIG. 1 and FIG. 2, one end of the conductive bar 320 may be connected to antenna connector 110 by being supported from the inner side of the housing 100 and the other end may be projected in a rod shape to be extended in an inner direction of the housing 100.

The coupling unit 300 may comprise a plurality of coupling cavities 330 which are formed inside the housing 100 so that the rod-type conductive bar 320 is able to pass through the inner side of the housing 100. The number of coupling cavities 330 may correspond to the number of plurality of feeding members 310.

According to an embodiment of the present invention, each of the coupling cavities 330 may be provided in a box shape as shown in FIG. 2 but it is not limited thereto. The coupling cavities 330 can be also provided in various types such as a cylindrical shape to control coupling volume.

The coupling cavities 330 can be arranged in a row or in a plurality of rows and columns to transmit wireless signals input/output through the antenna connector 110 along the conductive bar 320.

As shown in FIG. 2, each of the coupling cavities 330 may be a long groove shape formed in a direction from the upper part to the bottom part of the housing 100. Coupling partition walls 350 may be formed between coupling cavities 330 which form a groove at one side of the housing 100.

A coupling window 340 which is an opened part of the partition wall 350 may be formed to connect the adjacent coupling cavities 330 each other.

The conductive bar 320 may be supported by the coupling windows 340 formed at the coupling partition wall 350 to pass through the plurality of coupling cavities 330 and the plurality of coupling partition walls 350. Here, a supporting member (not shown) may be provided on the coupling window 340 to support the conductive bar 320.

The conductive bar 320 may be formed with a conductive metal material. The conductive bar 320 may transmit wireless signals input/output through the antenna connector 110 to each band-pass filter unit 200 through the feeding member 310 formed along the longitudinal direction or vice versa. According to an embodiment of the present invention, for example, the 50 ohm conductive bar 320 may transmit wireless signals by being connected to the resonator 220 of the adjacent cavity 210 in an open type.

Here, the feeding member 310 feeds (connects) to a band-pass filter unit 200 corresponding to a particular frequency band from wireless signals having various frequency bands transmitted through the conductive bar 320.

Thus, each feeding member 310 may be arranged to be spaced-apart in predetermined intervals not to affect to the frequency bands of adjacent filters.

The feeding member 310 according to an embodiment of the present invention may be extended outwardly from the central axis of the conductive bar 320 to have a greater diameter than that of the conductive bar 320. Particularly, the feeding member 310 may be a cylindrical shape formed by being extended outwardly from the peripheral surface of the conductive bar 320.

Each feeding member 310 may be arranged to be spaced-apart in predetermined intervals according to design conditions from the most adjacent resonator 220 of the corresponding band-pass filter unit 200. As shown in FIG. 1 and FIG. 2, the feeding member 310 and the resonator 220 may be arranged to be spaced-apart and opposed to each other.

According to an embodiment of the present invention, the peripheral surface of the cylindrical feeding member 310 may be arranged to be spaced-apart from the adjacent resonator 220 (in an open type to be coupled each other).

Thus, coupling volume of wireless signals transmitted through the feeding member 310 may be changed by controlling the distance between the most adjacent resonator 220 and the feeding member 310.

Coupling volume of wireless signals transmitted through the feeding member 310 may be changed by controlling the number of the cavity 210 and the resonator 220, size of the resonator 220, diameter of the conductive bar 320, distance between the resonator 220 and the feeding member 310, size of the window formed between the coupling cavity 330 and the cavity 210. This may finally vary a frequency bandwidth.

According to an embodiment of the present invention, the conductive bar 320 and the feeding member 310 may be manufactured in an integral (modular) type. The conductive bar 320 and the feeding member 310 formed in an integral type can be easily installed on the plurality of coupling cavities 330 in the housing 100. Accordingly, reliability and durability of a product as such manufactured can be improved, compared to that having a short type coupling structure manufactured by a conventional soldering.

The coupling structure according to an embodiment of the present invention is a structure having the linear conductive bar 320 which is mounted on each band-pass filter unit 200 and the plurality of coupling cavities 330 which are connected in a serial line. This structure is simpler than a conventional structure so that not only the productivity can be increased but also manufacturing cost can be lowered by reducing consumption of unnecessary materials.

According to an embodiment of the present invention, when the coupling unit 300 is implemented in an open type as a coupling structure which is a simple-linear structure and thus easy to be installed, the interference phenomenon between filter units can be minimized without increasing the size of a multiplexer since controlling the distance between filter units becomes easy. In addition, an open-type coupling structure which is easy to be installed and has a simple-linear structure is implemented so that the productivity can be increased due to the simple-linear coupling structure which simplifies a manufacturing process.

Figure 3:
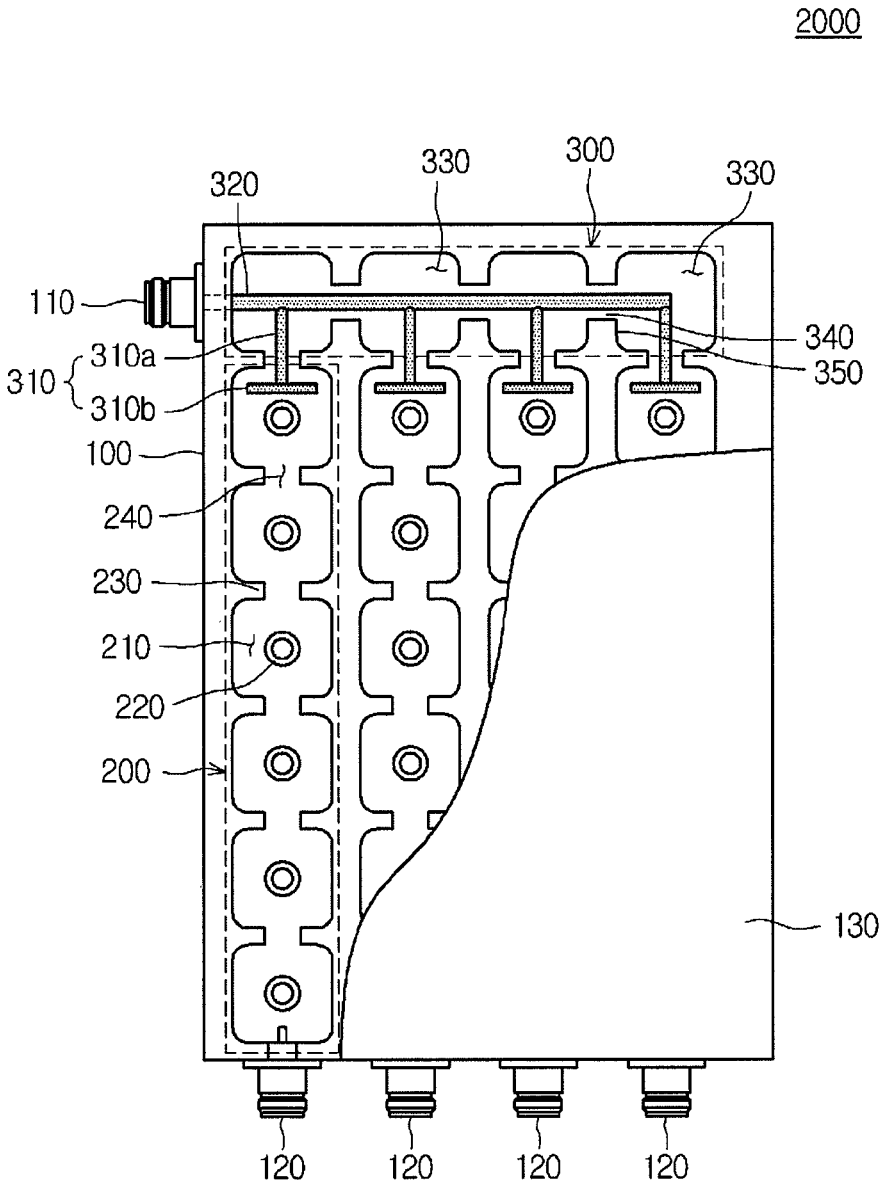
FIG. 3 illustrates a multiplexer with a common port feeding structure viewed from the top according to the second embodiment of the present invention.
Figure 4:
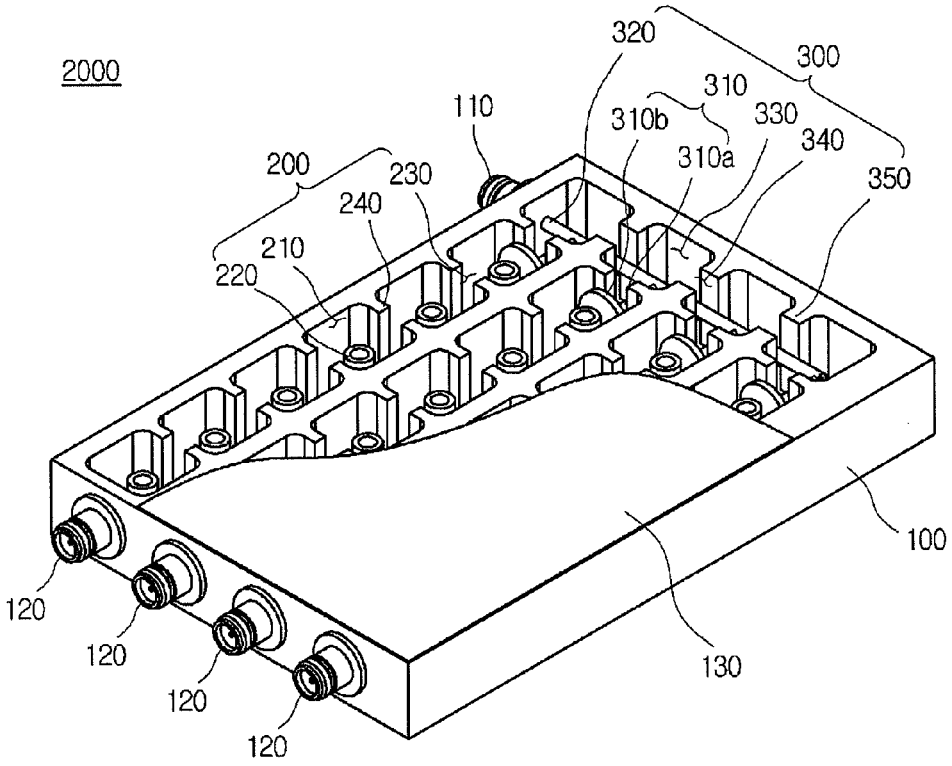
FIG. 4 is a perceptive view illustrating the multiplexer with a common port feeding structure according to the second embodiment of the present invention of FIG. 3.

FIG. 3 illustrates a multiplexer with a common port feeding structure viewed from the top according to the second embodiment of the present invention 2000 and FIG. 4 is a perceptive view illustrating the multiplexer with a common port feeding structure according to the second embodiment of the present invention 2000 of FIG. 3.

In the description of the following embodiments of the present invention, redundant explanations, which are the same or are in correspondence with the multiplexer with a common port feeding structure 1000 according to the previous embodiments of the present invention, are omitted. It will be explained based on a coupling unit 300 which is different from the previous embodiments.

As shown in FIG. 3 and FIG. 4, the coupling unit 300 according to an embodiment of the present invention may comprise a rod-shaped conductive bar 320 and a plurality of feeding members 310 which are arranged to be spaced-apart along the longitudinal direction of the conductive bar 320.

According to an embodiment of the present invention, the feeding member 310 may be configured in a different type from the previous embodiments.

Particularly, the feeding member 310 may comprise a rod-shaped coupling bar 310*a* which is extended outwardly from the central axis of a conductive bar 320 and a coupling disk 310*b* which is provided at the end part of the coupling bar 310*a*.

The coupling disk 310*b* shown in FIG. 3 and FIG. 4 is a cylindrical shape but it is not limited thereto. The coupling disk 310*b* may be changed in various shapes such as square or hexagonal shape as needed.

Each feeding member 310 may be arranged to be spaced-apart in predetermined intervals according to design conditions from the most adjacent resonator 220 of the corresponding band-pass filter unit 200. As shown in FIG. 3 and FIG. 4, the feeding member 310 and the resonator 220 may be arranged to be spaced-apart and opposed to each other.

According to an embodiment of the present invention, the coupling disk 310*b* of the feeding member 310 may be arranged to be spaced-apart from the adjacent resonator 220 (in an open type to be coupled each other).

Thus, coupling volume of wireless signals transmitted through the feeding member 310 may be changed by controlling the distance between the most adjacent resonator 220 and the feeding member 310.

Figure 5:
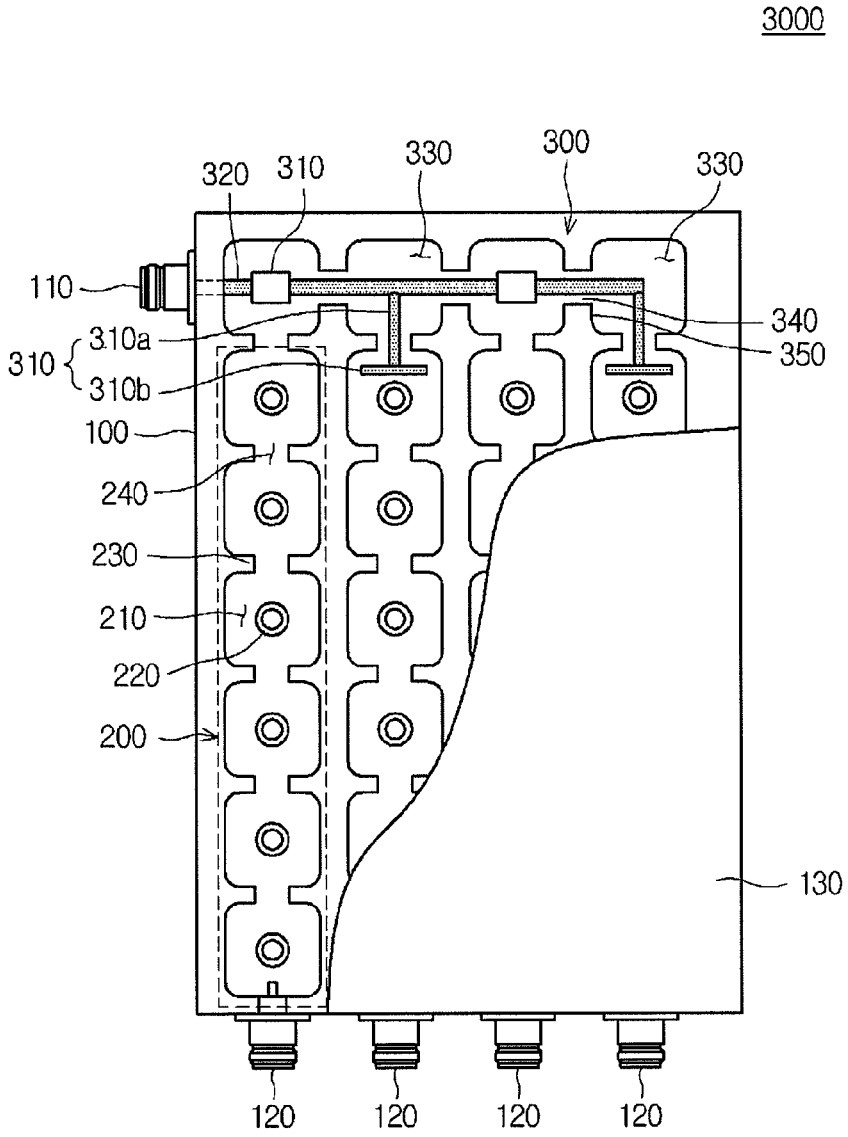
FIG. 5 illustrates a multiplexer with a common port feeding structure viewed from the top according to the third embodiment of the present invention.

FIG. 5 illustrates a multiplexer with a common port feeding structure viewed from the top according to the third embodiment of the present invention 3000.

In the description of the following embodiments of the present invention, redundant explanations, which are the same or are in correspondence with the multiplexer with a common port feeding structures 1000, 2000 according to the previous embodiments of the present invention, are omitted. It will be explained based on a coupling unit 300 which is different from the previous embodiments.

As shown in FIG. 5, the coupling unit 300 according to an embodiment of the present invention may comprise a rod-shaped conductive bar 320 and a plurality of feeding members 310 which are arranged to be spaced-apart along the longitudinal direction of the conductive bar 320.

According to an embodiment of the present invention, the feeding member 310 may be configured to include both the cylindrical feeding member 310 which is described previously and the feeding member 310 including the coupling bar 310*a* and the coupling disk 310*b*.

The cavity 210 and the coupling cavity 330 in FIG. 5 are box shapes but it is not limited thereto. The shape thereof can be changed into various shapes to control coupling volume according to design conditions.

Figure 6:
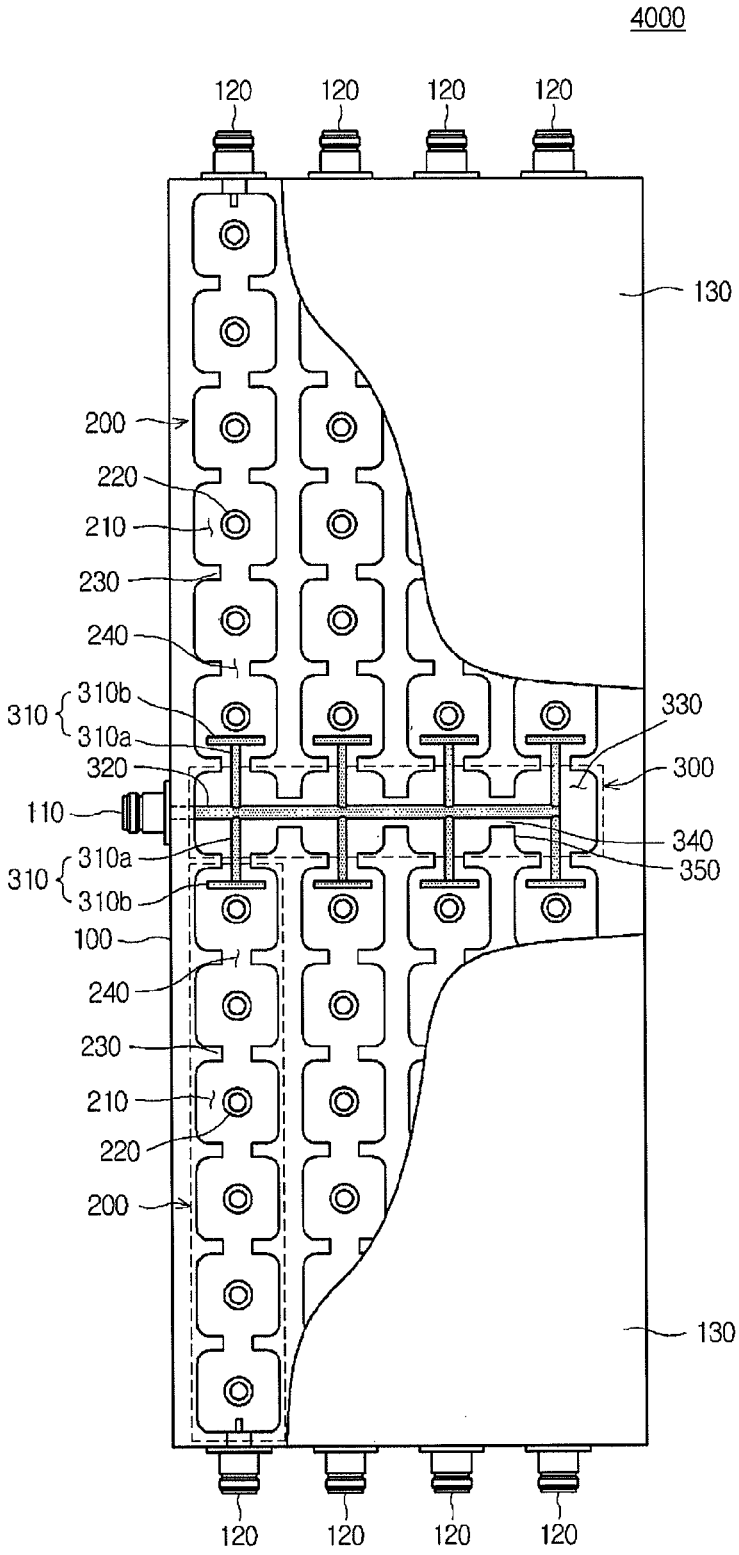
FIG. 6 illustrates a multiplexer with a common port feeding structure viewed from the top according to the fourth embodiment of the present invention.

FIG. 6 illustrates a multiplexer with a common port feeding structure viewed from the top according to the fourth embodiment of the present invention 4000.

In the description of the following embodiments of the present invention, redundant explanations, which are the same or are in correspondence with the multiplexer with a common port feeding structures 1000, 2000, 3000 according to the previous embodiments of the present invention, are omitted. It will be explained based on a configuration which is different from the previous embodiments.

Referring to FIG. 6, a plurality of band-pass filter units 200 and a plurality of input/output connectors 120 may be arranged in bilateral or multi-axis directions on the basis of the coupling unit 300 which is located at the center.

According to an embodiment of the present invention, the linear coupling unit 300 is located in the center and the plurality of band-pass filter units 200 and the plurality of input/output connectors 120 are arranged in a row to both sides therefrom.

In addition, even though it is not illustrated, when the multiplexer 4000 is viewed from the top, the coupling unit 300 may be arranged in a vertical direction at the center and the plurality of band-pass filter units 200 and the plurality of input/output connectors 120 may be arranged radially (in multi-axis directions) on the basis of the coupling unit 300 as a central axis.

Accordingly, the implementation of the common antenna port feeding structure of the present invention allows using a plurality of wireless communication services by using one antenna and even using each wireless communication service at the same time.

While it has been described with reference to particular embodiments, it is to be appreciated that various changes and modifications may be made by those skilled in the art without departing from the spirit and scope of the embodiment herein, as defined by the appended claims and their equivalents. It should be interpreted that all spirits equivalent to the following claims fall within the scope of the present invention.

What is claimed is:

1. A multiplexer with a common port feeding structure comprising:

a housing comprising an antenna connector connected to an antenna for bidirectional transmitting and receiving and a plurality of input/output connectors bidirectionally inputting and outputting a specific frequency band of wireless signals which are inputted/outputted through the antenna;

a plurality of band-pass filter units mounted inside the housing to transmit the wireless signals between the antenna connector and the respective input/output connectors to pass the specific frequency band; and a coupling unit having a plurality of feeding members to couple the antenna connector and each of the plurality of band-pass filter units, wherein the plurality of band-pass filter units and the plurality of input/output connectors are arranged radially around a central axis of the coupling unit.

2. A multiplexer with a common port feeding structure comprising:

a housing comprising an antenna connector connected to an antenna for bidirectional transmitting and receiving and a plurality of input/output connectors bidirectionally inputting and outputting a specific frequency band of wireless signals which are inputted/outputted through the antenna;

a plurality of band-pass filter units mounted inside the housing to transmit the wireless signals between the antenna connector and the respective input/output connectors to pass the specific frequency band; and a coupling unit having a plurality of feeding members to couple the antenna connector and each of the plurality of band-pass filter units, wherein any one of the plurality of band-pass filter units comprises:

a plurality of cavities which are formed by grooves formed in a direction from an upper part to a bottom part of the housing between the antenna connector and the respective plurality of band-pass filter units;

a resonator installed in each of the plurality of cavities; and a partition wall formed with a window which is an open part of the partition wall to couple between the plurality of cavities.

3. A multiplexer with a common port feeding structure comprising:

a housing comprising an antenna connector connected to an antenna for bidirectional transmitting and receiving and a plurality of input/output connectors bidirectionally inputting and outputting a specific frequency band of wireless signals which are inputted/outputted through the antenna;

a plurality of band-pass filter units mounted inside the housing to transmit the wireless signals between the antenna connector and the respective input/output connectors to pass the specific frequency band; and a coupling unit having a plurality of feeding members to couple the antenna connector and each of the plurality of band-pass filter units, wherein the coupling unit comprises:

a rod-shaped conductive bar of which one end is connected to the antenna connector and the other end is extended in an inner direction of the housing; and a plurality of coupling cavities each of which is formed by a groove formed in a direction from an upper part to a bottom part of the housing between the antenna connector and the plurality of band-pass filter units, wherein the plurality of feeding members are arranged to be spaced-apart along a longitudinal direction of the rod-shaped conductive bar.

4. The multiplexer with the common port feeding structure of claim 3, wherein the number of the plurality of coupling cavities corresponds to the number of the plurality of feeding members, and the coupling unit is provided between the plurality of coupling cavities and the coupling unit further comprises a plurality of coupling partition walls having coupling windows which are opened parts of the coupling partition walls.

5. The multiplexer with the common port feeding structure of claim 4, wherein the conductive bar is arranged to pass through the plurality of coupling cavities and the plurality of coupling partition walls.

6. The multiplexer with the common port feeding structure of claim 3, wherein any one of the plurality of feeding members is arranged to be spaced-apart and opposed to a resonator adjacent to any one of the plurality of band-pass filter units.

7. A multiplexer with a common port feeding structure comprising:

a housing comprising an antenna connector connected to an antenna for bidirectional transmitting and receiving and a plurality of input/output connectors bidirectionally inputting and outputting a specific frequency band of wireless signals which are inputted/outputted through the antenna;

a plurality of band-pass filter units mounted inside the housing to transmit the wireless signals between the antenna connector and the respective input/output connectors to pass the specific frequency band; and a coupling unit having a plurality of feeding members to couple the antenna connector and each of the plurality of band-pass filter units, wherein the coupling unit comprises a rod-shaped conductive bar of which one end is connected to the antenna connector and the other end is extended in an inner direction of the housing, wherein the plurality of feeding members are arranged to be spaced-apart along a longitudinal direction of the rod-shaped conductive bar, and wherein each of the plurality of feeding members is extended outwardly from a central axis of the rod-shaped conductive bar and each of the feeding members have a greater diameter than that of the rod-shaped conductive bar.

8. A multiplexer with a common port feeding structure comprising:

a housing comprising an antenna connector connected to an antenna for bidirectional transmitting and receiving and a plurality of input/output connectors bidirectionally inputting and outputting a specific frequency band of wireless signals which are inputted/outputted through the antenna;

a plurality of band-pass filter units mounted inside the housing to transmit the wireless signals between the antenna connector and the respective input/output connectors to pass the specific frequency band; and a coupling unit having a plurality of feeding members to couple the antenna connector and each of the plurality of band-pass filter units, wherein the coupling unit comprises a rod-shaped conductive bar of which one end is connected to the antenna connector and the other end is extended in an inner direction of the housing, wherein the plurality of feeding members are arranged to be spaced-apart along a longitudinal direction of the rod-shaped conductive bar, and wherein any one of the plurality of feeding members comprises a rod-shaped coupling bar and a coupling disk which is coupled to the end part of the coupling bar, wherein the rod-shaped coupling bar is extended outwardly from a central axis of the rod-shaped conductive bar.

9. The multiplexer with the common port feeding structure of claim 8, wherein the coupling disk is a circular or polygonal shape.

10. A multiplexer with a common port feeding structure comprising:

a housing comprising an antenna connector connected to an antenna for bidirectional transmitting and receiving and a plurality of input/output connectors bidirectionally inputting and outputting a specific frequency band of wireless signals which are inputted/outputted through the antenna;

a plurality of band-pass filter units mounted inside the housing to transmit the wireless signals between the antenna connector and the respective input/output connectors to pass the specific frequency band; and a coupling unit having a plurality of feeding members to couple the antenna connector and each of the plurality of band-pass filter units, wherein the plurality of band-pass filter units and the plurality of input/output connectors are arranged on an upper and lower side of the coupling unit.

* * * * *